US005725041A

United States Patent [19]

Schultz

[11] Patent Number: 5,725,041

[45] Date of Patent: Mar. 10, 1998

[54] MOLDING MACHINE

[76] Inventor: Eugene F. Schultz, 10423-80th Ave., Clear Lake, Minn. 55319-9620

[21] Appl. No.: 663,647

[22] Filed: Jun. 14, 1996

[51] Int. Cl.[6] ..... B22D 31/00; B22D 45/00; B22D 29/00

[52] U.S. Cl. ..... 164/5; 164/70.1; 164/262; 164/264; 164/269; 164/347; 164/404; 164/131; 164/344

[58] Field of Search ..... 164/5, 70.1, 131, 164/344, 69.1, 262, 264, 269, 347, 404

[56] References Cited

U.S. PATENT DOCUMENTS

| | | |
|---|---|---|
| 3,563,302 | 2/1971 | Thevenin . |
| 3,627,023 | 12/1971 | Clark . |
| 3,672,437 | 6/1972 | Bennett . |
| 3,881,543 | 5/1975 | Hannes . |
| 3,990,501 | 11/1976 | Fisher et al. . |
| 4,060,121 | 11/1977 | Gwaltney et al. . |
| 4,715,424 | 12/1987 | Brown et al. . |

FOREIGN PATENT DOCUMENTS

| | | | |
|---|---|---|---|
| 6-198418 | 7/1994 | Japan | 164/70.1 |

*Primary Examiner*—Joseph J. Hail, III
*Assistant Examiner*—I. H. Lin
*Attorney, Agent, or Firm*—Palmatier, Sjoquist, Helget & Voigt, P.A.; Nelson R. Capes, Esq.

[57] ABSTRACT

A static pour, gravity feed permanent mold machine for molding a casting from molten metal heated in a furnace, consisting of a chassis, a die holder adapted to receive a reusable die, a reusable open-face die for insertion in the die holder, a vertically-oriented die ejection system for ejecting the casting from the die, an ejector pin lubrication system, horizontal mobile gating blocks which together form a gating system when brought together over the die opening, a horizontally-mounted degater for severing the gating system from the casting while the gating system and casting are still hot, a mobile casting receiver for removing the casting from machine, and a mobile robot arm for dipping molten metal from the furnace and for returning the gating system to the furnace for remelting.

19 Claims, 14 Drawing Sheets

MOLDING MACHINE

BACKGROUND OF THE INVENTION

The field of the invention is permanent mold casting. Permanent mold casting consists of gravity feeding molten metal into a set of reusable dies, waiting for the metal to solidify, and removing the casting. Permanent mold casting differs from other methods of casting in the following ways:

Die casting injects the molten metal under pressure.

Low-pressure casting places a small amount of atmospheric pressure on the metal, forcing it up into the die.

Investment casting uses non-reusable wax patterns that are melted out after the non-reusable die has been cast.

Lost foam casting uses non-reusable styrofoam patterns.

Sand casting uses non-reusable sand molds.

Centrifugal casting makes hollow castings by spinning the mold when the metal is in a molten state.

In permanent mold casting, the molten metal is poured into the reusable die through a gate, which is located above the die so that the metal enters the die under the influence of gravity. An important function of the gate is to provide a gating system which is basically a reservoir of molten metal above the die. As the metal in the die cools, it shrinks. In order to prevent the formation of air pockets in the die, the gating system supplies additional molten metal to the die as the die cools. The gating system consists of a riser and a sprue.

In earlier permanent mold casting machines, it was necessary to remove the casting and gating system as a unit and separate them after this "tree" has cooled. A major problem with these machines was that this causes an unnecessary waste of energy to heat the removed gating system back up to melting temperature so that it may be remelted and reused as molten metal.

There is a need for an improved permanent mold casting machine which allows the gating system to be separated from the casting while the gating system and casting are still hot, thus saving energy required to return the gating system to a molten state.

SUMMARY OF THE INVENTION

A static pour, gravity feed permanent mold machine for molding a casting from molten metal heated in a furnace, consisting of a chassis, a die holder adapted to receive a reusable die, a reusable open-face die for insertion in the die holder, a vertically-oriented casting ejection system for ejecting the casting from the die, an ejector pin lubrication system, horizontal mobile gating blocks which together form a gating system when brought together over the die opening, a horizontally-mounted degater for severing the gating system from the casting while the gating system and casting are still hot, a mobile casting receiver for removing the casting from the machine, and a mobile robot arm for dipping molten metal from the furnace and for returning the gating system to the furnace for remelting.

A principal object and advantage of the invention is that the gating system is severed from the casting while the casting and gating system are still hot and the gating system (i.e., riser and sprue) is returned to the furnace for remelting while it is still hot, thus saving energy in remelting the gating system.

Another object and advantage of the invention is that the gating block system allows for an unobstructed pouring area, extremely low gating block clamping pressure, easy die maintenance, automated degating, and automated air blast cleaning.

Another object and advantage of the invention is that the die holder allows for fast and easy die changes, the use of die cartridge heaters, and is thermally isolated from the rest of the machine to avoid premature cooling of the casting.

Another object and advantage of the invention is that the casting ejection system engages the die in such a manner as to allow fast and easy die changes and the automatic ejector pin lubrication system allows automatic lubrication of the ejector pins.

Another object and advantage of the invention is that the chassis provides integral forklift pockets for moving the molding machine. This eliminates the need to jack and block the machine when moving it.

Another object and advantage of the invention is the provision of a pivot cylinder adapted for tilting the chassis to allow air to escape smoothly from the die and to decrease turbulence in the flow of molten metal into the die.

Another object and advantage of the invention is that it may be controlled by a microcomputer to allow automation of the following functions: die preheat and temperature maintenance, mold opening, gating system separation, gating system removal, casting ejection, casting removal, die air blast, mold closure, ejector pin lubrication, and provision of a release spray between the die and the gating blocks.

A feature of the invention is automatic gating block closure, which eliminates the need to manually close the mold before pouring molten metal.

Another feature of the invention is automatic and consistent timing of the casting cooling cycle, eliminating the chance of opening the mold too soon or unnecessary waiting.

Another feature of the invention is automatic degating, that is, separation of the gating system from the casting, eliminating the need to manually degate.

Another feature of the invention is automatic removal of the casting from the mold, eliminating the need for manual casting removal.

Another feature of the invention is automatic die air-blast cleaning, eliminating the need for manual die air-blast cleaning.

Another feature of the invention is automatic ejector pin lubrication, eliminating the need for manual ejector pin lubrication.

Another feature of the machine is automatic tilt cylinder pulsing, eliminating the need for manual monitoring and resetting of tilt angle.

DETAILED DESCRIPTION OF THE PREFERRED EMBODIMENTS

Figure 1:
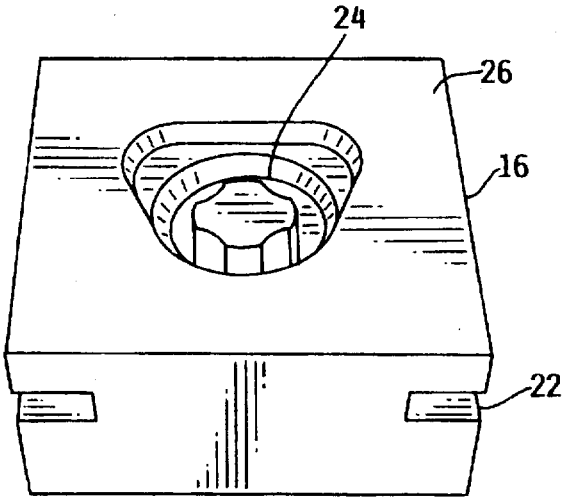
FIG. 1 is a top perspective view of the removable, reusable die.
Figure 2:
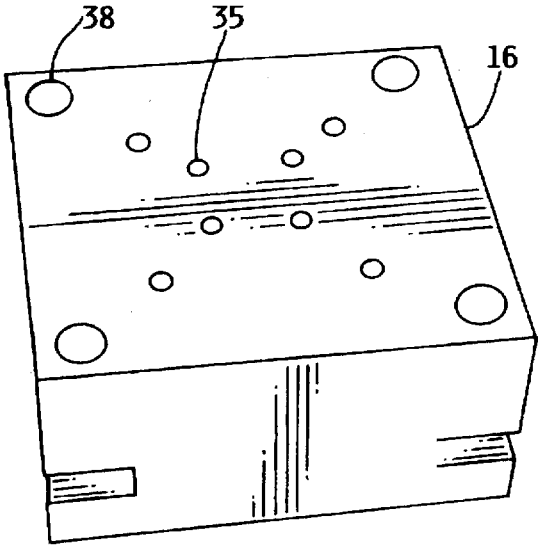
FIG. 2 is a bottom perspective view of the removable, reusable die.
Figure 3:
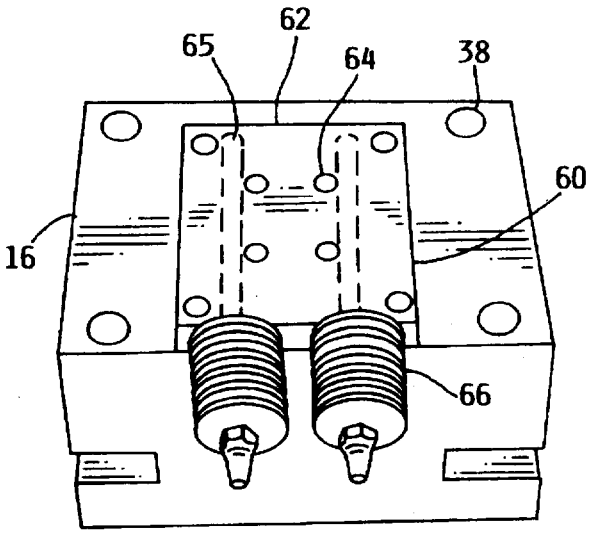
FIG. 3 is a bottom perspective view of the removable, reusable die with the ejector pin lubrication system attached.

The static pour, gravity feed permanent mold machine of the present invention is indicated in the Figures generally by the numeral 10.

The mold machine comprises a chassis 12. Mounted on the chassis 12 is a means 14 for holding a removable, reusable die 16. The means 14 may preferably be a die holder 18. The die holder 18 is preferably horizontally mounted and U-shaped and is mounted separately from other components for thermal isolation. The die holder 18 preferably has ledges 20 which receive matching grooves 22 in the die 16 to slide the die 16 onto the holder 18, enabling fast die changing. The die holder 18 may preferably have a heater 19 for preheating the die 16 and temperature maintenance during interruptions in the molding process. The heater 19 may be a cartridge heater which inserts into the die holder 18.

As best seen in FIG. 1, the die 16 preferably consists of a rectangular or square piece of metal with grooves 22 milled along the right and left sides to accommodate the ledges 20 of the die holder 18. The desired cavity 24 for the casting is milled into the top 26 of the die 16.

The molding machine 10 also comprises a casting ejection means 30 for automatically ejecting the casting from the die 16. The means 30 preferably comprises a casting ejection system 32 mounted on the die 16 and engaging the ejector plate receiver 50, as will be shown more particularly below.

Figure 6:
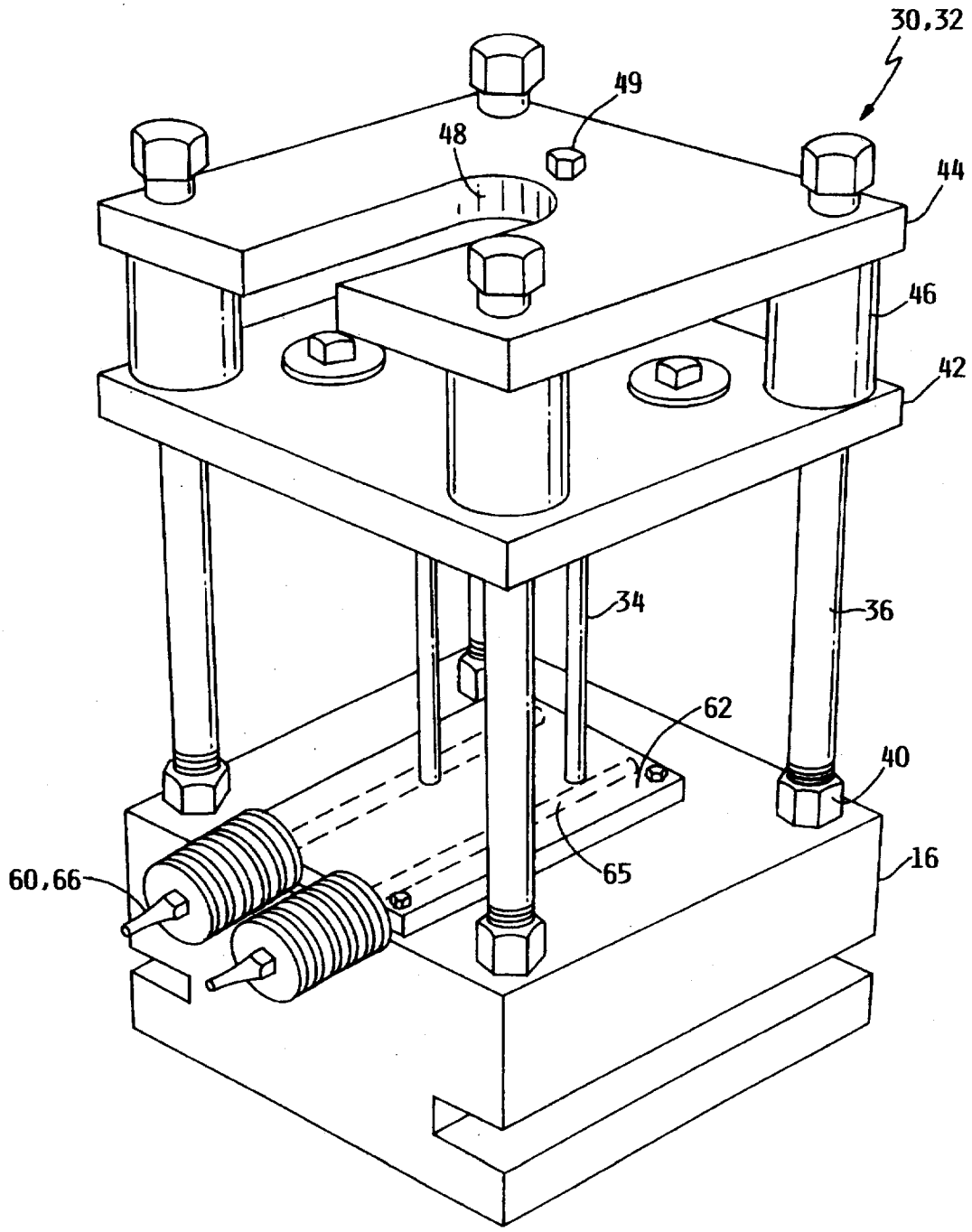
FIG. 6 is a perspective view of the die with the casting ejection system attached.

The casting ejection system 32 further comprises a plurality of ejector pins 34 adapted for ejecting the casting from the die 16. The casting ejection system engages the die 16 as follows. The ejector pins 34 slide through holes 35 in the die 16 to eject the casting from the die. Preferably there may be about 2/1000ths inch clearance between the ejector pins 34 and the holes 35. A plurality of threaded bolts 36 mate with corresponding tapped holes 38 in the bottom of the die 16. The ejection system 32 is connected to the die by turning in bolts 36 and tightening nuts 40 on the bolts 36. FIG. 6 shows the ejection system 32 attached to the die 16.

Figure 4:
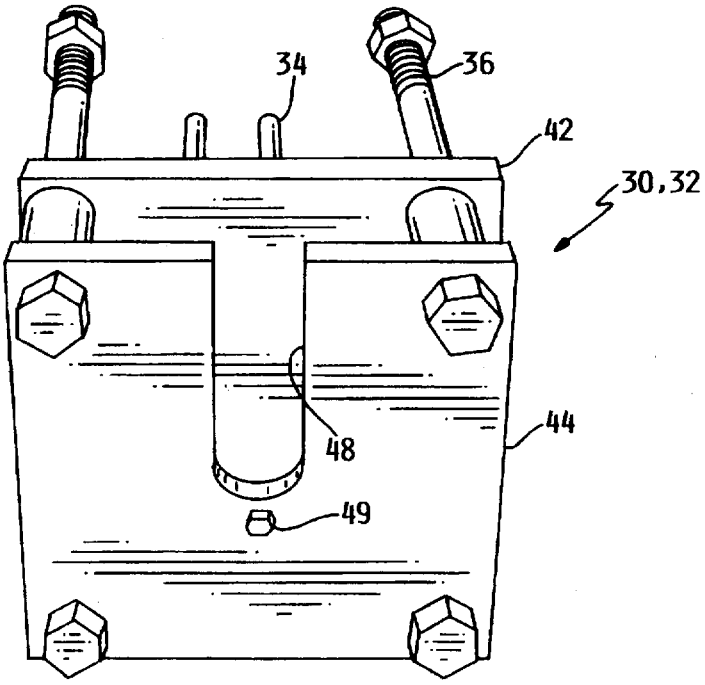
FIG. 4 is a bottom perspective view of the casting ejection system.
Figure 5:
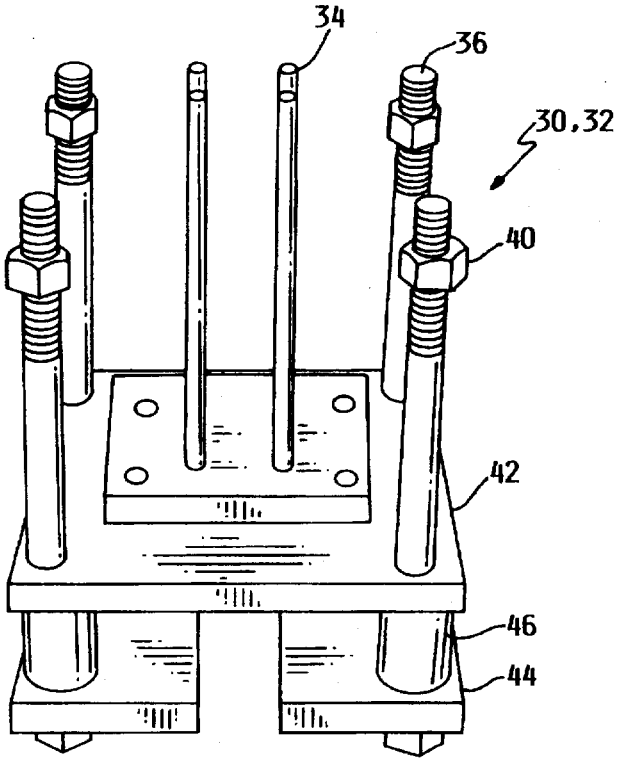
FIG. 5 is a front perspective view of the casting ejection system.

An ejector pin mounting plate 42 is preferably separated from the ejector plate 44 by spacers 46. The ejector plate 44 preferably has a slot 48 for receiving the ejector plate receiver 50. A bolt head 49 on the ejector plate 44 engages a slot 51 in the ejector plate receiver 50 to prevent unwanted motion (see FIGS. 4 and 7). The ejector plate receiver 50 is mounted to the chassis 12 and is moved up and down by an ejector plate cylinder (not shown). As the ejector plate 44, spacers 46, and ejector pin mounting plate 42 are pushed upwardly by the ejector plate receiver 50, these elements slide along the bolts 36, allowing the ejector pins 34 to eject the casting from the die.

The ejector plate receiver may be adjustable by slots 52 to accommodate differences in the position of the ejection system 32 for various dies.

To insert the die 16 and ejection system 32 into the chassis 10, the die 16 is slid into the die holder 18 with the ledges 20 matching the grooves 22. Simultaneously, the slot 48 of the ejector plate 44 slides into the ejector plate receiver 50.

Mounted on the die 16 is an ejector pin lubrication system 60. The ejector pin lubrication system 60 preferably consists of a metal plate 62 and insulator that is bolted to the bottom surface of the die 16. The plate 62 has holes 64 for the ejector pins 34 through its thickness. Partially intersecting holes 65 run the full length of the plate 62. The holes 65 connect to a quick disconnect fitting 66 which may be attached to a grease gun (not shown). The holes 65 are plugged with caps at the end of the plate 62 opposite the quick disconnect fitting 66. A computer (not shown) is programmed to activate the grease gun at appropriate intervals. If the lubricating grease should become hardened in the ejector pin plate 62, the intersecting holes are easily cleaned by removing the quick disconnect fitting 66 and caps and inserting a rod into the holes 65.

The mold machine 10 also preferably comprises a mobile gating means 70 for automatically forming a gating system 72 adapted for carrying the molten metal into the die 16. The gating system 72 comprises the sprue 71 and riser 73. The sprue 71 has a narrowed opening 74 for engaging the casting. The riser 73 also engages the casting through an opening 75.

Figure 10:
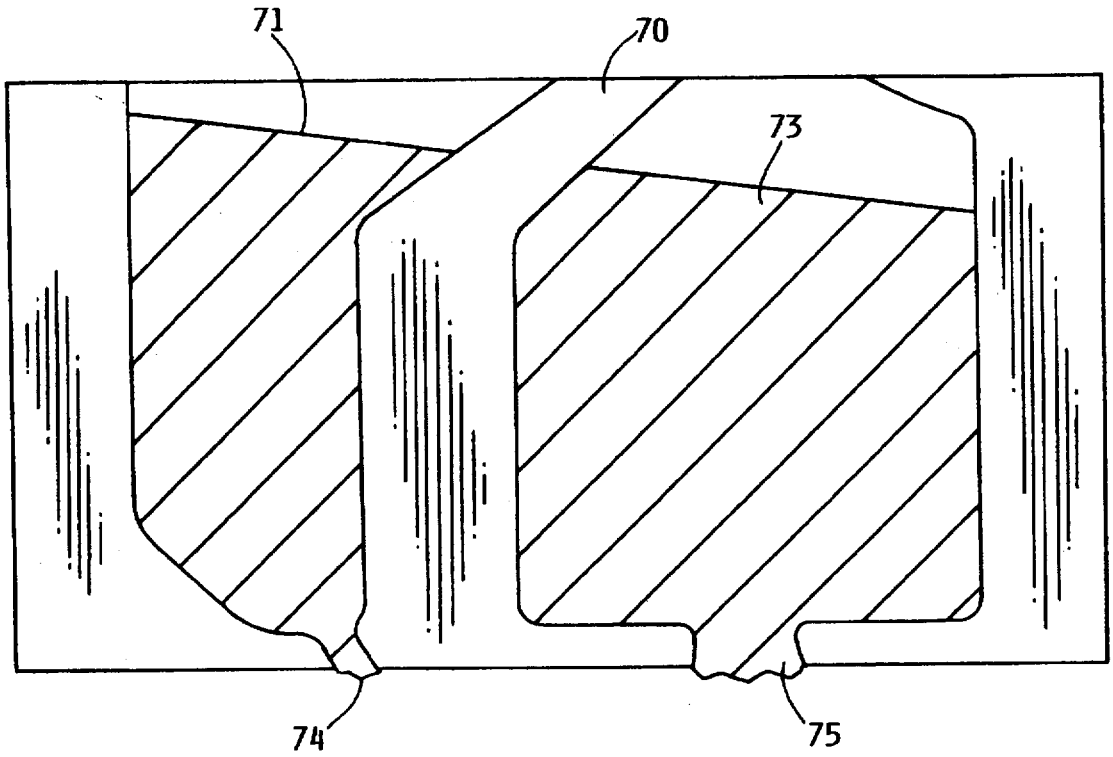
FIG. 10 is a cross-section taken along the lines 10 in FIG. 9.

The mobile gating means 70 preferably comprises a plurality of mobile gating blocks 80 mounted on the chassis 12. The gating blocks 80 mate to form the gating system 72. The gating blocks 80 each comprise one-half of a riser cavity 73 and one-half of a sprue cavity 71. The sprue enters the die through a narrow opening 74. The opening 74 is broad enough to allow the die to be filled quickly with molten metal yet narrow enough to be easily severed from the casting while the casting is partially solidified. Also, the opening 74 is canted as shown in FIG. 10 to allow easy severing from the casting.

Figure 7:
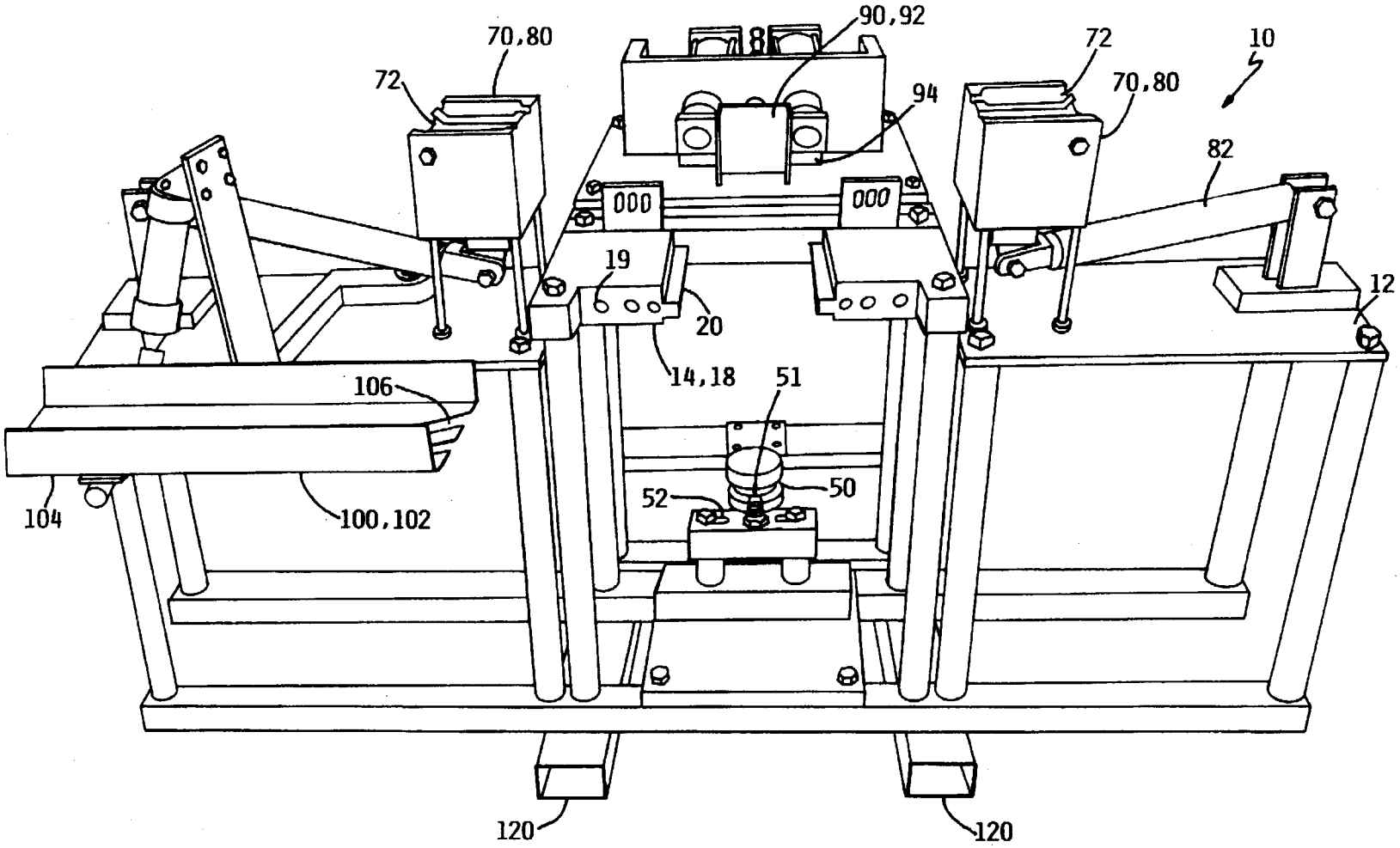
FIG. 7 is a front perspective view of the molding machine without the die attached.

The gating blocks 80 are brought horizontally apart and together by gating block hydraulic cylinders 82. The gating blocks 80 are preferably pivotable from a substantially horizontal operating position (FIG. 9) to a substantially vertical maintenance position (FIG. 7).

The mold machine 10 also preferably comprises an automatic degating means 90 for severing the gating system 72 from the casting while the gating system 72 and the casting are still hot. "Degating" refers to the act of separating the gating system 72 from the casting. The automatic degating means 90 preferably comprises a mobile degater 92 mounted on the chassis 12 and adapted for severing the gating system 72 from the casting.

The mold machine 10 also preferably comprises an automatic casting receiver means 100 for removing the casting from the mold machine 10. The automatic casting receiver means 100 preferably comprises a mobile casting receiver 102 mounted on the chassis 12. The casting receiver 102 is preferably a tray 104 with slotted holes 106 adapted for bypassing the ejector pins 34. The casting is lowered onto the tray 104 by the ejector pins 34. The tray 104 is preferably adapted to swing away from the mold machine 10 (FIG. 16) and adapted to tilt for depositing the casting in a shipping container 108.

The mold machine 10 also preferably comprises a means 110 for automatically transporting molten metal to the mold machine and automatically returning the gating system 72 back to the furnace for reheating. The means 110 preferably comprises a mobile robot arm 112 comprising a ladle 114 adapted for transporting molten metal to the mold machine 10 and a carrier 116 for transporting the gating system 72 back to the furnace for reheating.

The mold machine 10 may also comprise fork lift pockets 120 for moving the mold machine.

Figure 17:
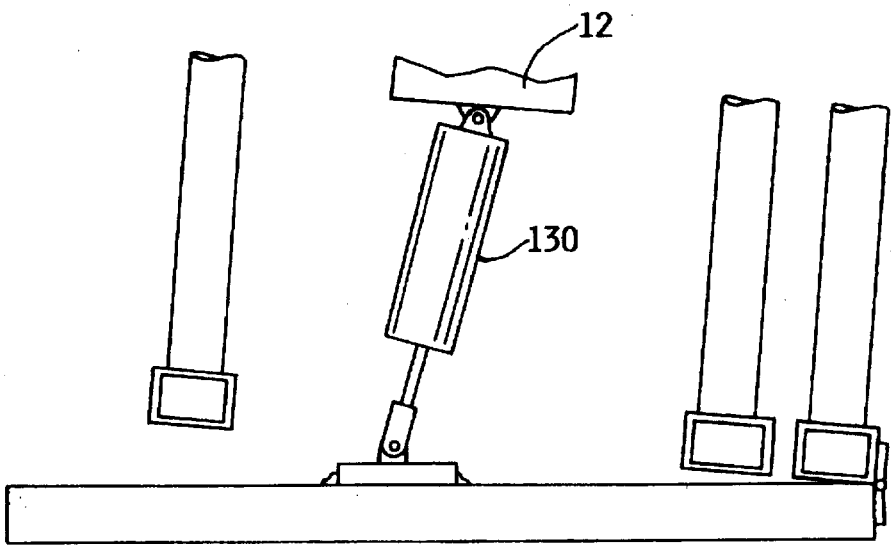
FIG. 17 is a detailed partial view of the tilt cylinder.
Figure 18:
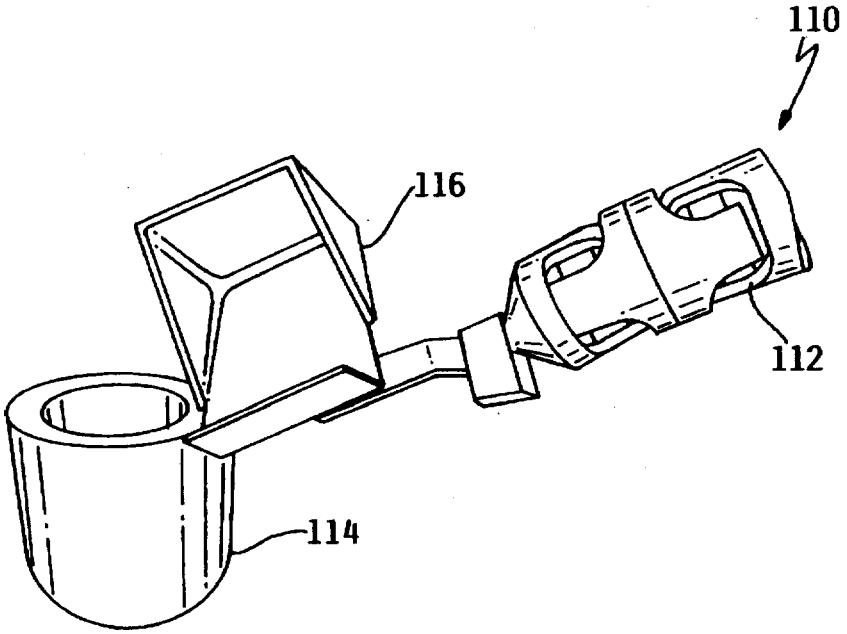
FIG. 18 is a detailed partial view of the robot arm.

As seen in FIG. 17, the mold machine 10 may also comprise a pivot cylinder 130 adapted for tilting the chassis 12 to allow air to escape smoothly from the die 16 and to decrease turbulence in the flow of molten metal into the die 16.

The mold machine 10 may also preferably comprise a gating block pressure regulator (not shown) adapted for regulating the closing pressure of the gating blocks 80.

The mold machine 10 may also preferably comprise a layer of release spray (not shown) on the top surface of the die 16 and die holder 18 for lubricating the motion of the gating blocks 80 and preventing molten metal from becoming attached to the die 16 and die holder 18.

The mold machine 10 may also preferably comprise an air manifold 94 mounted on the degater 92 and adapted for air blast cleaning of the mold machine 10.

Having described the structure of the mold machine 10, the operation of the mold machine 10 may now be appreciated as follows.

Figure 8:
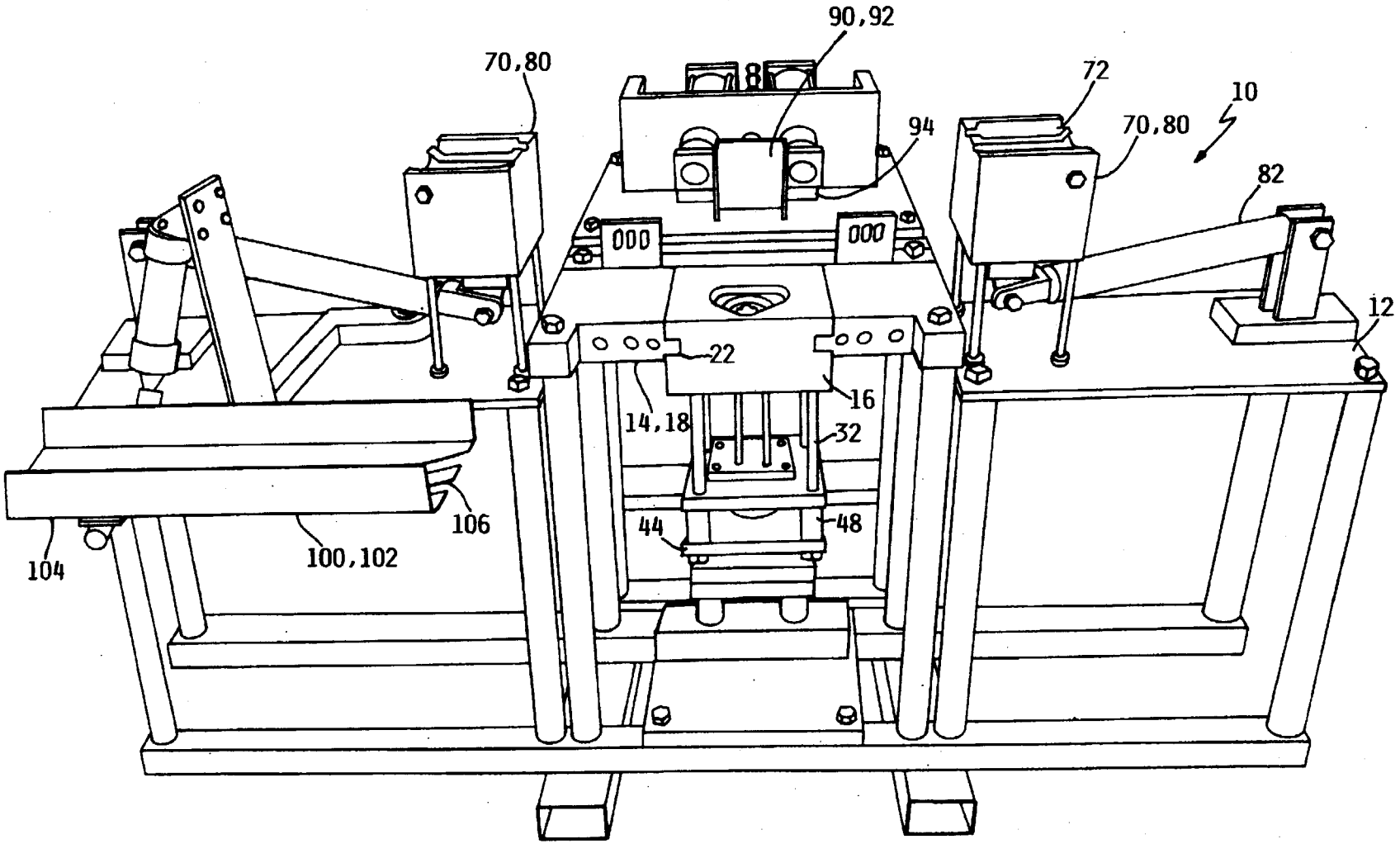
FIG. 8 is a front perspective view of the molding machine with the die attached and showing the gating blocks in maintenance position.
Figure 9:
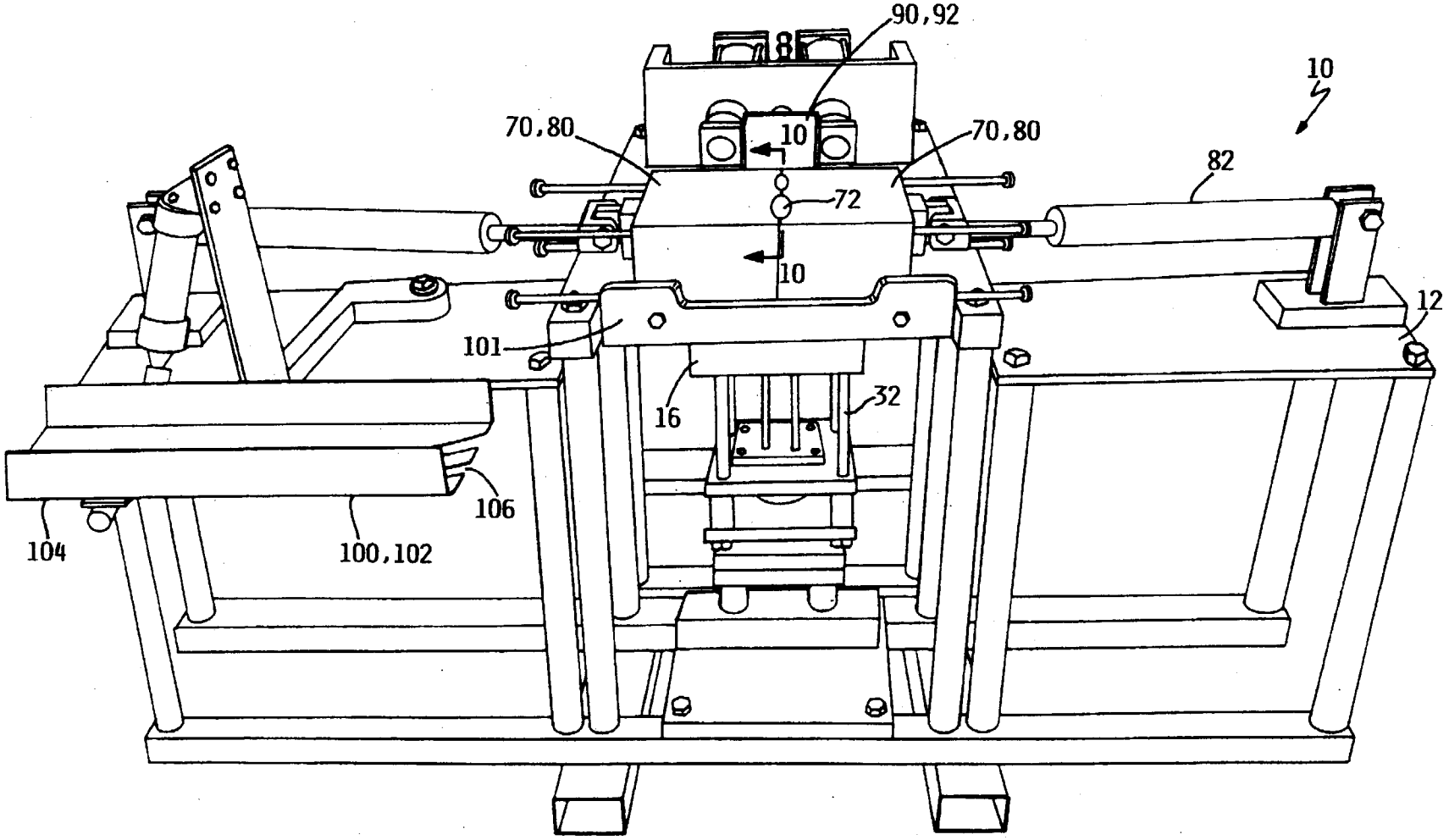
FIG. 9 is a front perspective view of the molding machine with the gating blocks closed together over the die.

The die 16 is first inserted into the die holder 18, as shown in FIG. 8. The die 16 is then held in place by the die retainer/gating block guide plate 101 as shown in FIG. 9. The mold machine 10 may preferably be tilted by the pivot cylinder 130 so that the rear of the machine 10 is higher than the front of the machine 10. This allows the gating blocks to come together more easily along the die retainer/gating block guide plate 101 and also allows a smoother pour of molten metal and less splashing of the molten metal within the die 16 and gravity assist during degating and air blast functions.

Then, the gating blocks 80 are pivoted to their horizontal operating position and brought together by means of the gating block cylinders 82 to form the gating system 72, as is best seen in FIG. 9.

The robot arm 112 now moves to the furnace, in a step not shown in the Figures, and pours the molten metal into the die 16 through the sprue 71. As molten metal fills the die 16, air is exhausted through the riser 73 and molten metal fills the riser 73 to the same level as the sprue 71. The molten metal in the riser 73 provides a reservoir of metal to accommodate shrinkage within the die 16 as the metal cools.

Figure 11:
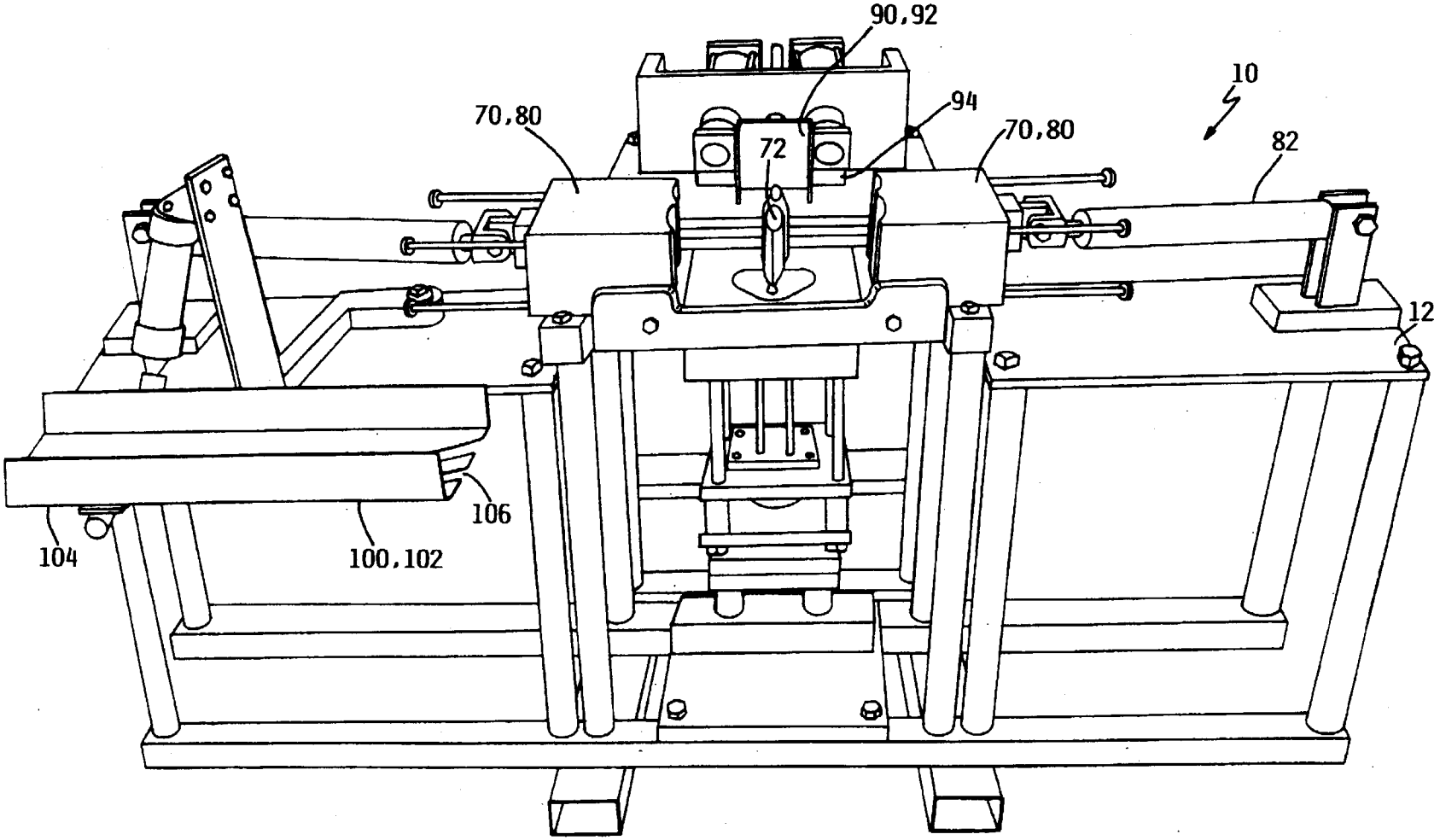
FIG. 11 is a front perspective view of the molding machine with the gating blocks opened, showing the gating system attached to the casting.

The molten metal is allowed to cool to the point where it is still somewhat plastic. Then the gating blocks 80 are moved apart by the gating block cylinders 82, exposing the gating system 72, as best seen in FIG. 11.

Figure 12:
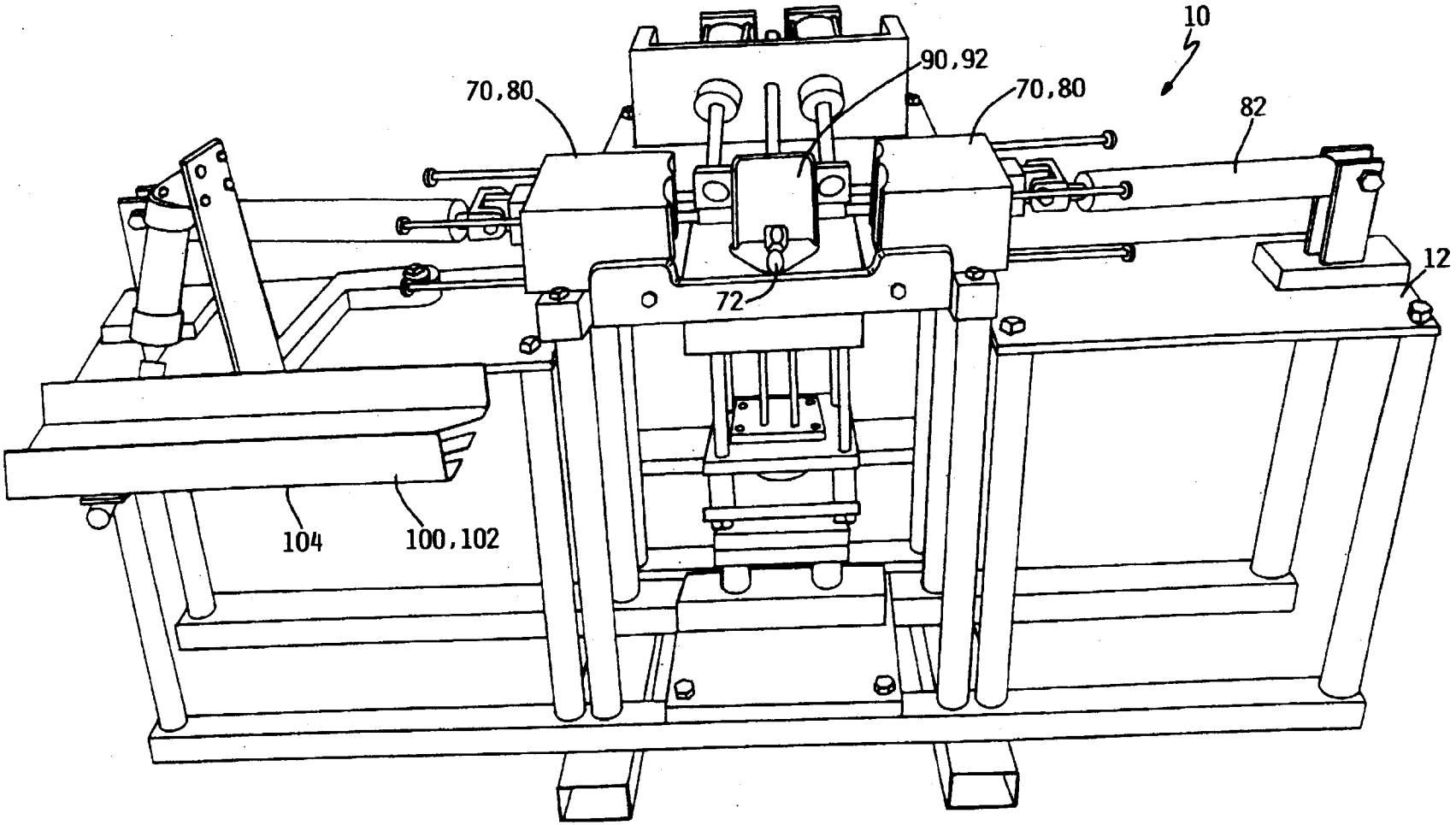
FIG. 12 is a front perspective view of the molding machine with the gating blocks opened, showing the degater severing the gating system from the casting.

Next, the mobile degater 92 moves toward the gating system 72 and severs the gating system 72 from the casting, as is best seen in FIG. 12. The robot arm 112 will have been positioned in such a manner that the severed gating system 72 falls into the carrier 116. The robot arm 112 then transports the severed gating system 72 back to the furnace for reheating while the gating system 72 is still hot, thus saving energy in remelting the gating system 72. While the robot arm is at the furnace, it may receive molten metal to pour the next casting, thus saving robot arm movement.

Figure 13:
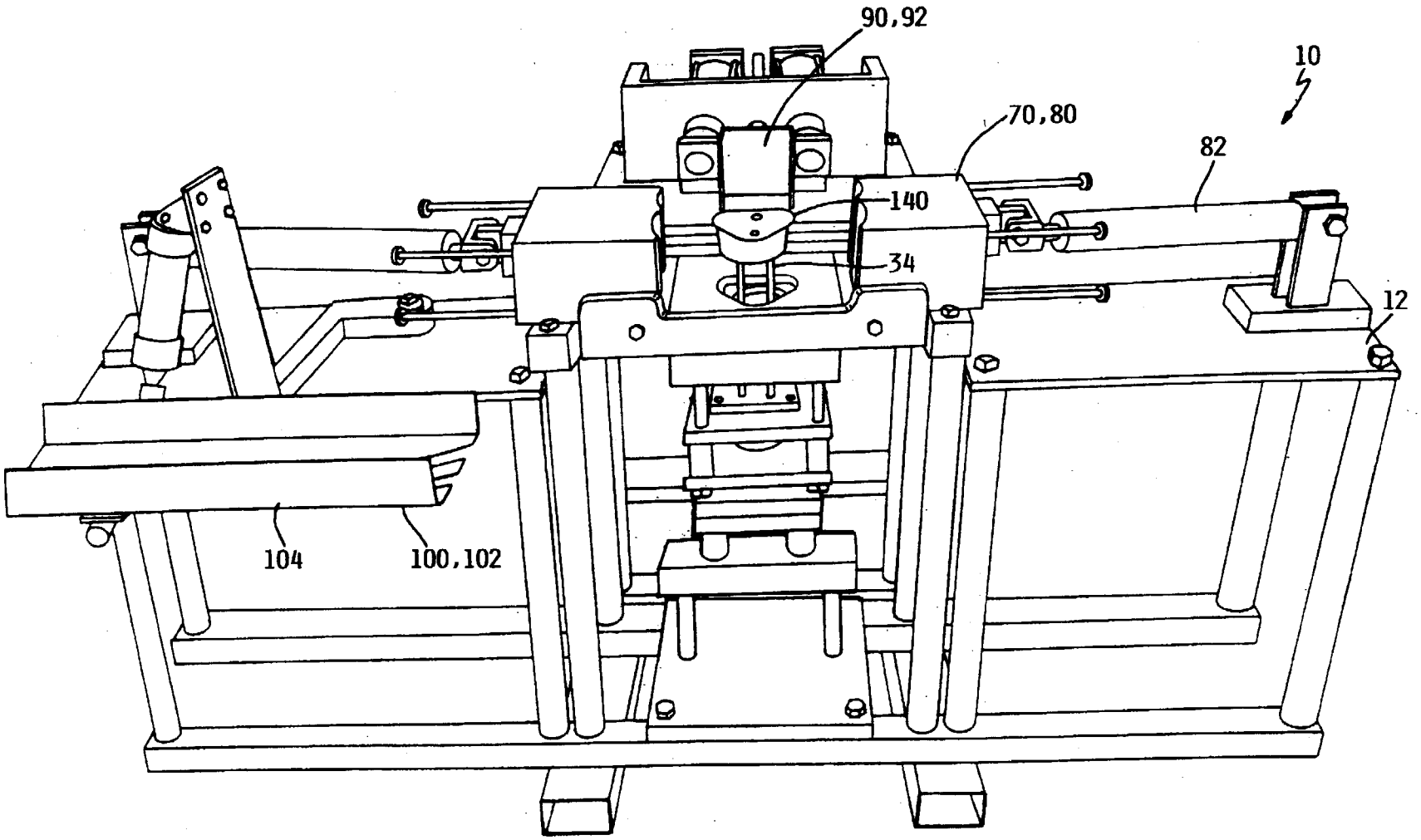
FIG. 13 is a front perspective view of the molding machine with the gating blocks opened, showing the casting ejection system removing the casting from the die.

In the next step, the ejector pins 34 are used to eject the casting 140 from the die 16, as is best seen in FIG. 13.

Figure 14:
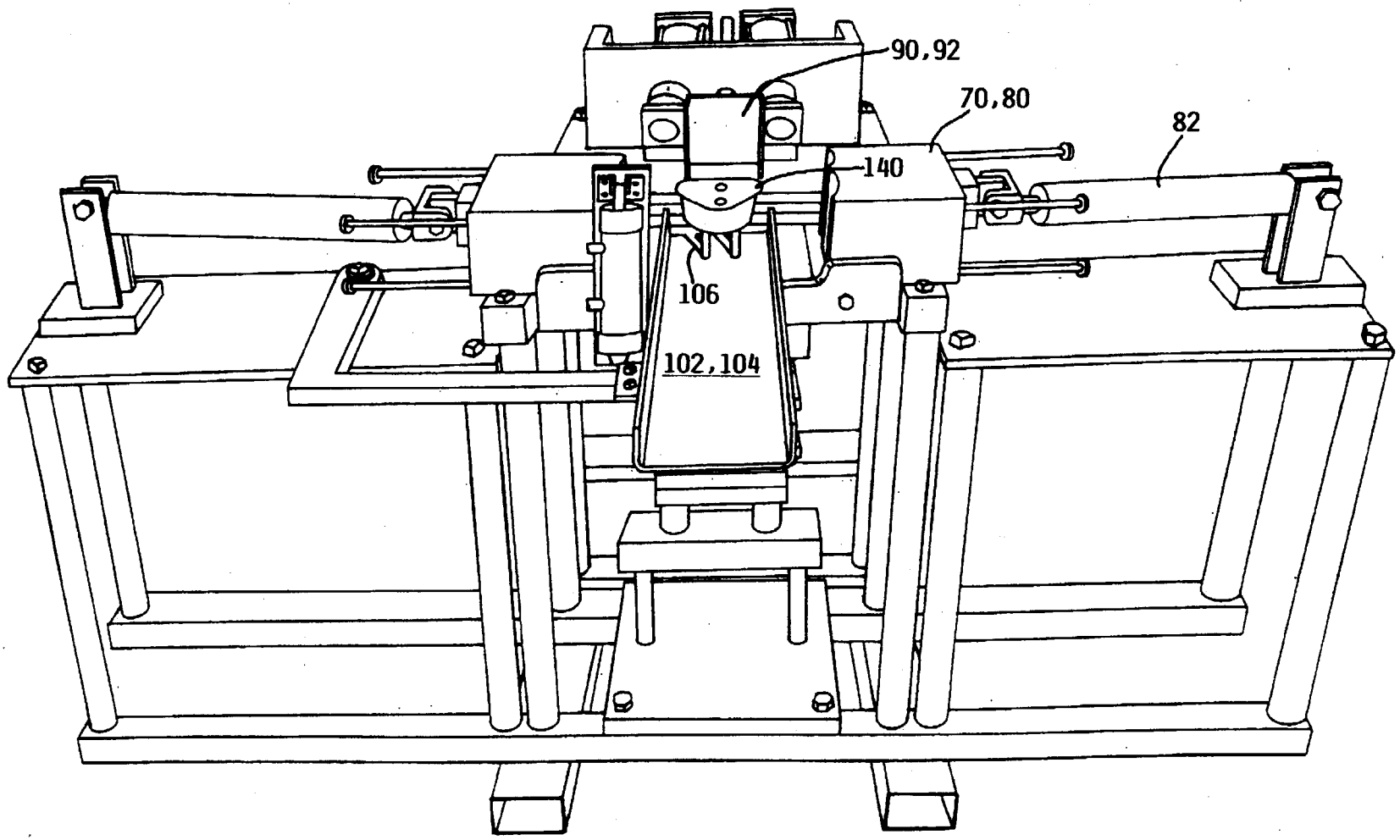
FIG. 14 is a front perspective view of the molding machine with the gating blocks opened, showing the casting receiver in position to receive the casting.

Next, the casting receiver 102 is positioned below the casting 140 with the slot 106 bypassing the ejector pins 34. See FIG. 14.

Figure 15:
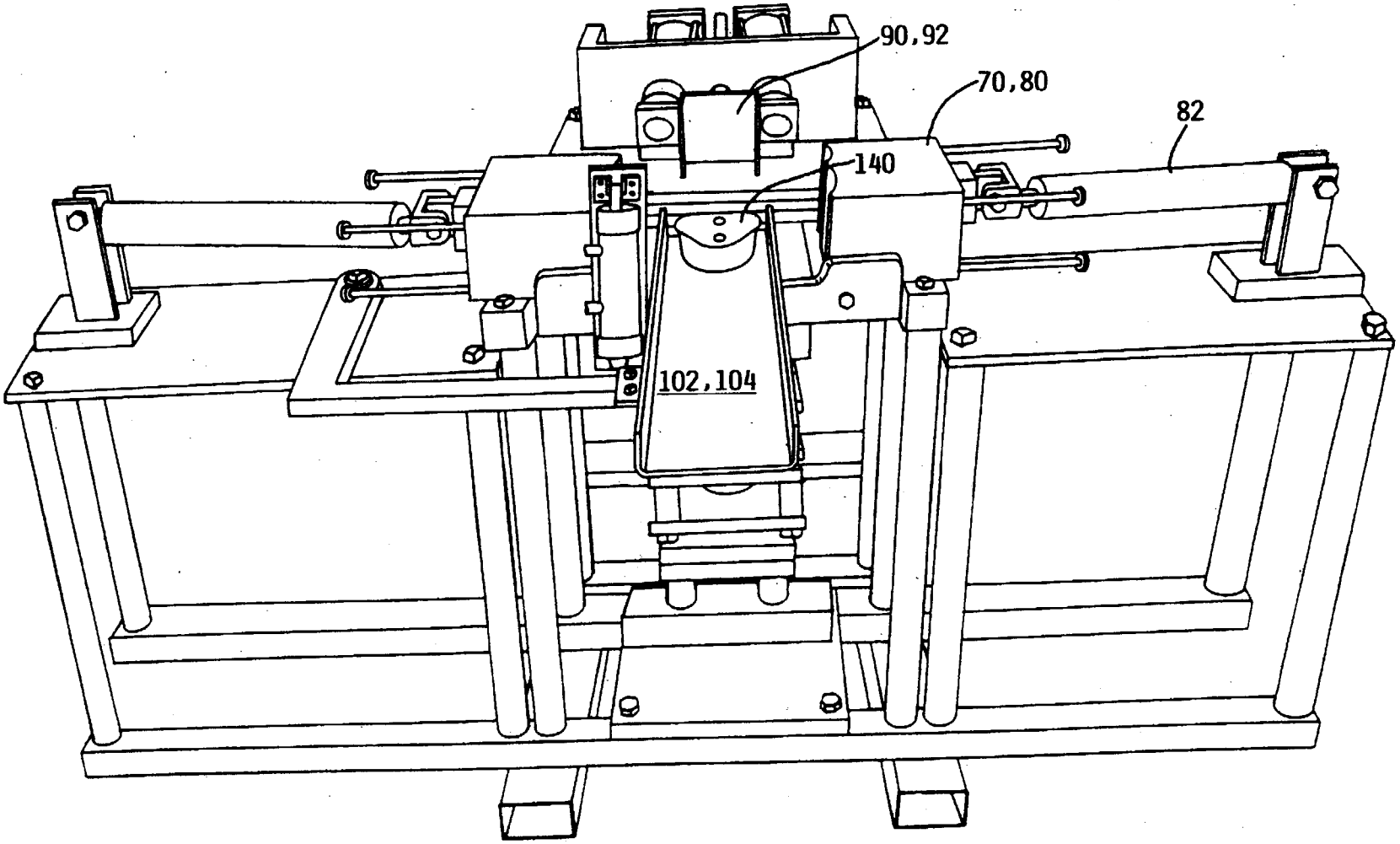
FIG. 15 is a front perspective view of the molding machine with the gating blocks opened, showing the casting being lowered onto the casting receiver by the casting ejection system.

In the next step, the ejector pins 34 lower the casting 140 onto the casting receiver 102, as is best seen in FIG. 15.

Figure 16:
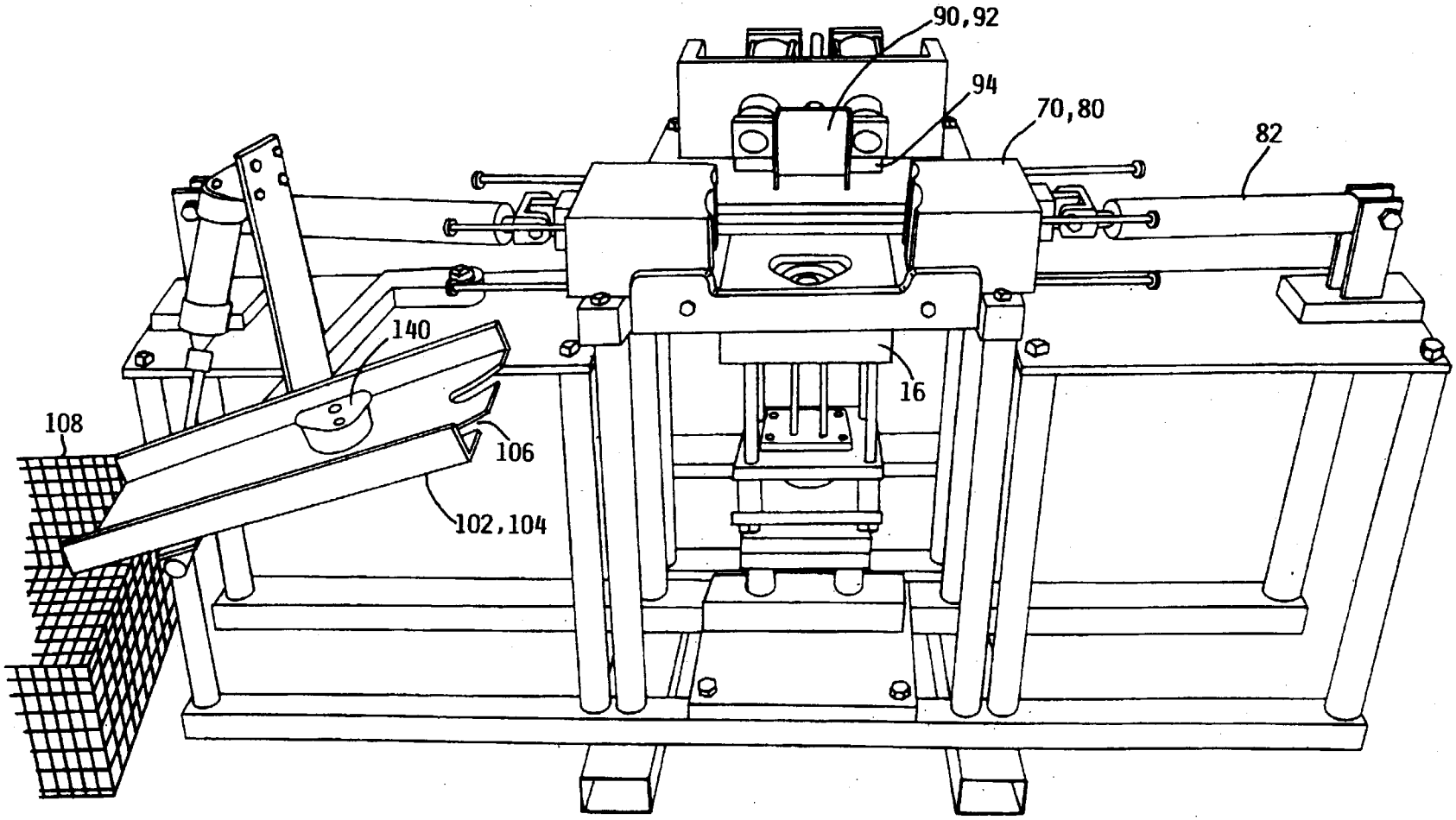
FIG. 16 is a front perspective view of the molding machine with the casting receiver delivering the casting to a shipping container.

Finally, the casting receiver 102 swings away from the mold machine 10 and tilts to deposit the casting 140 in a shipping container 108, as is best seen in FIG. 16. As this step is happening, the mobile degater 92 with its air manifold 94 moves over the die to air blast clean the die 16 and gating blocks 80.

The mold machine 10 may be controlled by a microcomputer to allow automation of the following functions: die preheat and temperature maintenance, mold opening, gating system separation, gating system removal, casting ejection, casting removal, die air blast, mold closure, ejector pin lubrication, and provision of a release spray between the die and the gating blocks.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed:

1. A static pour, gravity feed permanent mold machine for molding a casting from molten metal heated in a furnace, comprising:

a chassis, means for holding a removable, reusable die, a removable, reusable die, casting ejection means for automatically ejecting the casting from said die, mobile gating means for automatically forming a gating system adapted for carrying the molten metal into said die, said gating system having a narrowed opening for engaging the casting, automatic degating means for severing said gating system from the casting while said gating system and the casting are still hot, automatic casting receiver means for removing the casting from the mold machine, and means for automatically transporting molten metal to the mold machine and automatically returning said gating system back to the furnace for re-heating.

2. The mold machine of claim 1, wherein said casting ejection means comprises a plurality of vertically-oriented ejector pins.

3. The mold machine of claim 2, further comprising an ejector pin lubrication system mounted on said die.

4. The mold machine of claim 1, wherein said gating means comprises a plurality of horizontally mobile gating blocks, each of said gating blocks forming one-half of a riser cavity and one-half of the sprue cavity.

5. A static pour, gravity feed permanent mold machine for molding a casting from molten metal heated in a furnace, comprising:

a chassis, a die holder mounted on said chassis, said die holder adapted for receiving and holding a removable, reusable die, a removable, reusable die adapted for insertion in said die holder, casting ejection system mounted on said die and said casting ejection system having a plurality of ejector pins adapted for ejecting the casting from the die, an ejector pin lubrication system mounted on said die, a plurality of mobile gating blocks mounted on said chassis, said gating blocks mating to form a gating system adapted for carrying the molten metal into said die, said gating system having a narrowed opening for engaging the casting, a mobile degater mounted on said chassis and adapted for severing said gating system from the casting, a mobile casting receiver for removing the casting from the mold machine, and a mobile robot arm comprising a ladle adapted for transporting molten metal to the mold machine and a carrier for transporting said gating system back to the furnace for reheating.

6. The mold machine of claim 5, said chassis further comprising integral forklift pockets for moving said mold machine.

7. The mold machine of claim 5, said chassis further comprising a pivot cylinder adapted for tilting said chassis to allow air to escape smoothly from said die and to decrease turbulence in the flow of molten metal into said die.

8. The mold machine of claim 5, said die holder further comprising ledges and said die further comprising grooves engaging said ledges adapted for insertion of said die into said die holder.

9. The mold machine of claim 5, said die holder further comprising a heater adapted for preheating said die and for temperature maintenance during interruptions in the molding process.

10. The mold machine of claim 5, further comprising a plurality of gating block hydraulic cylinders adapted for moving said gating blocks horizontally apart and together.

11. The mold machine of claim 5, said gating blocks each comprising one-half of a riser cavity and one-half of a sprue cavity, said sprue cavity entering said die through a narrow opening, said narrow opening being broad enough to allow said die to be filled quickly with molten metal yet narrow enough to be easily severed from the casting while the casting is partially solidified.

12. The mold machine of claim 5, wherein said gating blocks are pivotable from a substantially horizontal operating position to a substantially vertical maintenance position.

13. The mold machine of claim 5, further comprising a gating block pressure regulator adapted for regulating the closing pressure of said gating blocks.

14. The mold machine of claim 5, further comprising a layer of release spray on the top surface of said die and die holder for lubricating the motion of said gating blocks and preventing molten metal from becoming attached to said die and said die holder.

15. The mold machine of claim 5, further comprising an air manifold mounted to said degater adapted for air blast cleaning said mold machine.

16. The mold machine of claim 5, said casting receiver further comprising a tray with slotted holes adapted for bypassing said ejector pins, the casting being lowered onto said tray by said ejector pins.

17. The mold machine of claim 16, said tray adapted to swing away from said die and adapted to tilt for depositing the casting in a shipping container.

18. A method of static pour, gravity feed permanent mold casting comprising the steps of:

inserting a reusable, removable die into a die holder, forming a gating system above the die by bringing together separate gating blocks, each of which forms one-half of a riser cavity and one-half of a sprue cavity, ladling molten metal from a furnace, pouring molten metal into the die through the sprue cavity, filling the casting and the riser cavity, allowing the molten metal to cool to a plastic state, separating the gating blocks to allow access to the gating system, severing the gating system from the casting while the gating system and the casting are still hot, returning the gating system to the furnace for remelting while the gating system is still hot, ejecting the casting from the die, and removing the casting from the mold machine.

19. The method of claim 18, wherein the steps of returning the gating system to the furnace and ladling molten metal from the furnace are performed sequentially by a single robot arm, thus saving arm movement.

* * * * *